United States Patent [19]

Laesser

[11] 4,244,039

[45] Jan. 6, 1981

[54] ELECTRO-MECHANICAL WATCH

[75] Inventor: Claude Laesser, La Chaux-de-Fonds, Switzerland

[73] Assignee: Ebauches S.A., Neuchatel, Switzerland

[21] Appl. No.: 902,734

[22] Filed: May 3, 1978

[30] Foreign Application Priority Data

May 6, 1977 [CH] Switzerland ..... 5734/77

[51] Int. Cl.[3] ..... G04B 9/00

[52] U.S. Cl. ..... 368/66; 368/203; 368/204

[58] Field of Search ..... 320/48; 58/23 R, 23 BA, 58/50 R; 368/203, 204, 66

[56] References Cited

U.S. PATENT DOCUMENTS

| | | | |
|---|---|---|---|
| 3,665,703 | 5/1972 | Cobarg | 58/23 BA X |
| 3,894,278 | 7/1975 | Gerum | 58/23 BA X |
| 3,898,790 | 8/1975 | Takamune et al. | 58/23 BA |
| 3,993,985 | 11/1976 | Chopard et al. | 58/23 BA X |
| 3,998,043 | 12/1976 | Tamaru et al. | 58/23 BA X |
| 4,024,415 | 5/1977 | Matsuura | 58/23 BA X |
| 4,041,691 | 8/1977 | Chihara et al. | 58/23 BA |
| 4,043,112 | 8/1977 | Tanaka | 58/23 BA |
| 4,074,515 | 2/1978 | Asano | 58/23 BA |

*Primary Examiner*—Ulysses Weldon

*Attorney, Agent, or Firm*—Silverman, Cass & Singer, Ltd.

[57] ABSTRACT

An electronic timepiece indicates a change in one of the working parameters of the timepiece, such as the battery nearing its end of life, by changing a rest position of a user viewable indicating member. The timepiece includes a stepping motor driven by drive pulses produced from a timebase. The indicating member is rotated a certain amount by each step of the stepping motor and has two rest positions. The first indicates no change in the working parameter and the second indicates a change in the working parameter. The indicating member normally stops in the first rest position. A circuit responsive to a change in the working parameter causes an additional drive pulse to be applied to the motor, changing the normal stopping of the indicating member to the second rest position to indicate the changed working parameter.

2 Claims, 5 Drawing Figures

ELECTRO-MECHANICAL WATCH

BACKGROUND OF THE INVENTION

The present invention relates to an electromechanical watch including a timebase, a step by step or stepping motor driving time indicating members and a control circuit of the motor, which is itself controlled by the timebase.

The object of the present invention is to provide such a watch with means giving several indications relating, for instance, to the state or condition of the source of energy (battery or accumulator), the time of the day (morning or evening), the state of the alarm (running or rest) in the case of an alarm-watch, etc.

Concerning the indication of the end of life of the source of energy, which constitutes the main application of the present invention, it has to be noted that means are already known which allow detection and display of a diminution of the voltage of the source of energy. Such an arrangement appears, for instance, in Swiss Patent Application Ser. No. 6,627/73, in which an electro-optic passive display device is specially intended to indicate the end of life of the battery. This solution has however the drawback of being a supplementary device when the means for displaying the time is mechanical ones.

In another document, i.e. German Patent Application (DOS) Ser. No. 2,513,845, the end of life of the source of energy is indicated by one of the hands of the watch, the movement of the one hand being different when the voltage of the source of energy is lower than a threshold value. This solution is particularly adapted to the watches provided with a second hand, otherwise such a device is not easy to read.

SUMMARY OF THE INVENTION

The electro-mechanical watch according to the invention is characterized by the fact that it comprises an indicating member driven by the motor and means allowing modification of the phase of the indicating member.

BRIEF DESCRIPTION OF THE DRAWING

The drawing shows, by way of example, one embodiment of the invention and a modification.

DESCRIPTION OF THE PREFERRED EMBODIMENT

Figure 1:
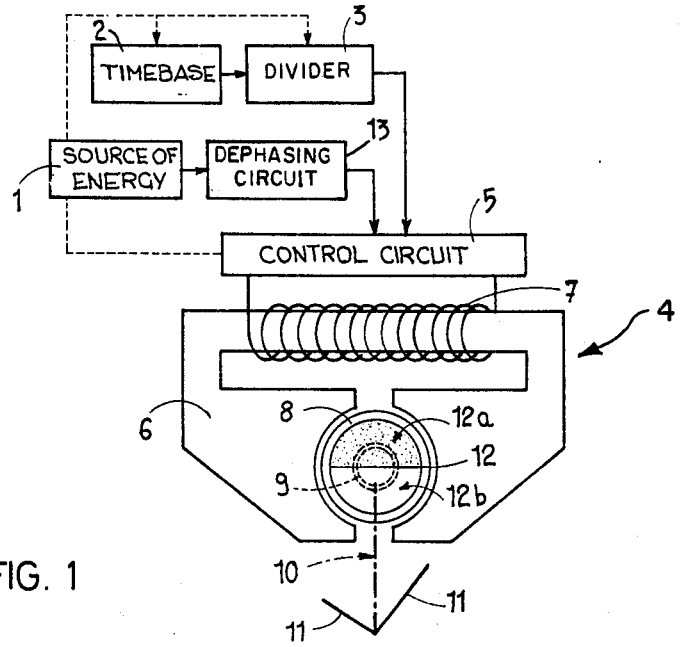
FIG. 1 is a block-diagram of an electro-mechanical watch provided with means indicating the end of life of the source of energy.

The watch represented includes a source of energy 1, i.e. a battery, but which could also be an accumulator or a rechargeable battery, a timebase 2, constituted for instance by a quartz oscillator, a circuit of division or divider 3, a motor 4 and a control circuit 5 of this motor. The motor 4 includes a stator 6, provided with a coil 7, and a two-pole rotor 8. Such a motor is disclosed, for instance, in French Pat. No. 1,033,643. The signals coming from the timebase 2 are divided by the divider 3 which is connected to the control circuit 5 of the motor 4.

The rotor 8 is rigidly connected with a pinion 9 which drives, by the intermediary of a gearing diagrammatically represented by a dot-and-dash line 10, the time indicating members, diagrammatically represented at 11.

The rotor 8 of the motor is rigidly connected with a disc 12 provided with two sectors **12*a* and 12*b*, each covering an angle of 180 degrees, of and each being different color, one being green and the other red, for instance. It is to be noted that the number of the zones or sectors of the disc 12 having different appearances, has to correspond to the number of the poles of the rotor of the motor and which can be different from two, which determines the number of stable positions of balance of the rotor. A dial which is not represented, is provided with a window having the shape of a sector of a circle, making one of the sectors 12*a* and 12*b* of the disc 12 viewable disc is stationary, like the window 43 of dial 44 represented in the modification of FIG. 5**.

The control circuit 5 is arranged in such a way that each time the motor is put in motion, its rotor 8 advances a number of steps equal to the number of stable positions it can occupy, i.e. two in the present case, thus making a whole revolution. In this way, one of the two zones **12*a* and 12*b* of the indicating disc 12 appears in the window of the dial only a very short time when the motor is rotating. This time being only a few milliseconds, the observer has thus the impression or perception that the other zone or sector of the disc 12** is permanently displayed.

The watch comprises moreover a dephasing circuit 13 constituted by a circuit of detection or of checking of the state of the source of energy 1, which sends its information to the control circuit 5 of the motor 4. This circuit dephasing 13 is such that, when the voltage of the source of energy 1 reaches a threshold value, which is predetermined, the dephasing circuit sends information to the control circuit 5 so that the rotor 8 of the motor 4 advances only one step during its next movement. Hence, it is the second zone of the disc 12 which seems to appear permanently in the window of the dial, the motor then being driven at the rate of two steps at each of its movements.

Thus, the user knows, owing to the change of the color appearing in the window of the dial, that he has to change the battery of the watch or to charge the accumulator or rechargeable battery.

Figure 2:
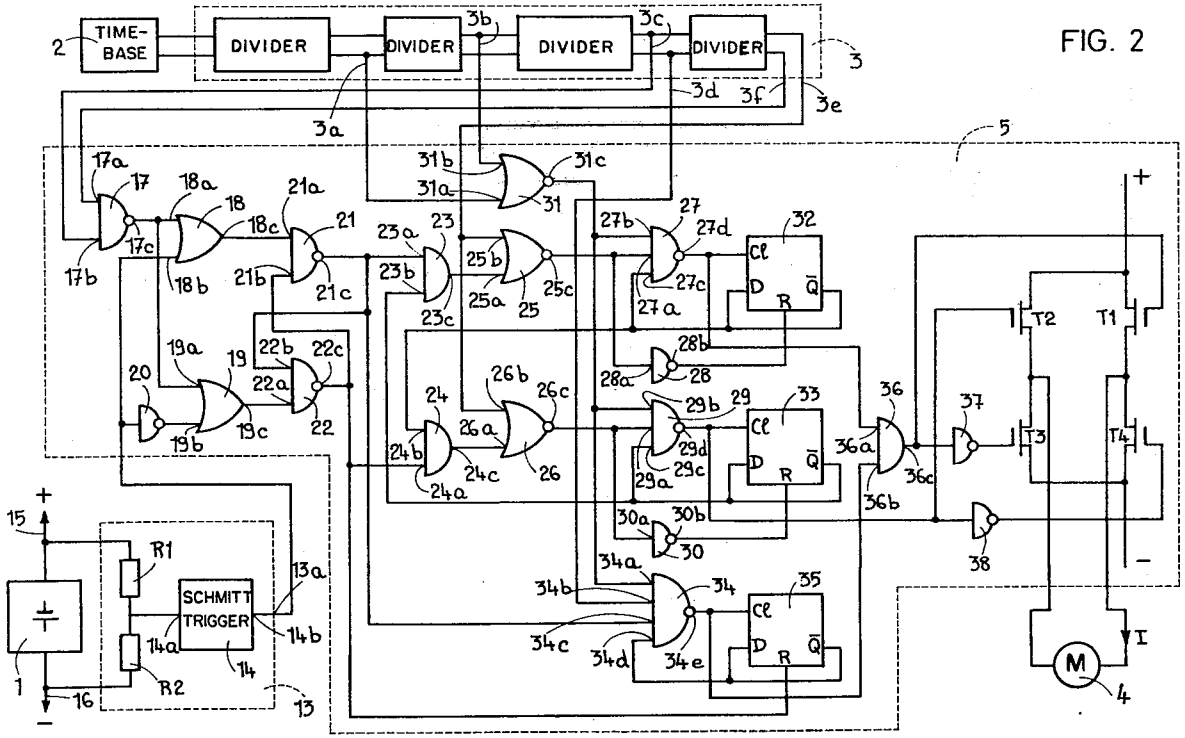
FIG. 2 represents the circuit of this watch in a more detailed way.

FIG. 2 shows in detail the control circuit 5 of the motor 4 and the dephasing circuit 13 constituted, as indicated hereabove, by a circuit of detection or of checking of the of the source of energy. Relating to this last circuit, it is to be noted that numerous embodiments are possible, but that only the one represented is especially simple. The output **13*a* of this circuit 13 is constituted by the output 14*b* of a Schmitt-trigger 14 the input 14*a* of which is connected to the middle point of a voltage divider constituted by two resistances R1 and R2. The resistances are selected in such a way that, as long as the voltage of the source 1 is higher than or equal to a predetermined voltage, the voltage applied to the input 14*a* of the Schmitt-trigger 14 is higher than or equal to its threshold voltage the output 14*b* of this trigger delivers a logic signal 1 . When the voltage of the source 1 is under the predetermined value, the voltage applied to the input 14*a* of the Schmitt-trigger 14** falls under the threshold voltage and the output 14b delivers a logic signal 0.

The connection between the source 1 and the circuits of the watch has not been represented in detail but has been symbolized by two arrows 15 and 16 provided with the signs + and −, respectively.

Figure 4:
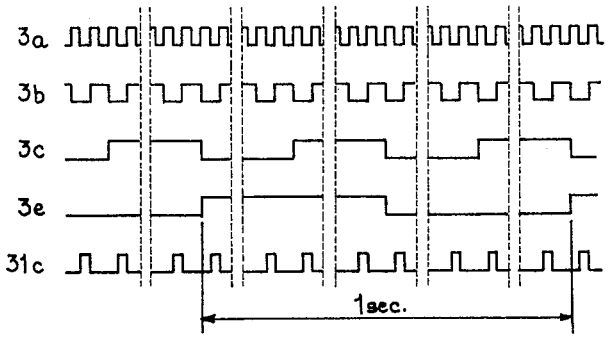

The chain of dividers of the divider 3 are provided with outputs 3a to 3f delivering signals having frequencies which are submultiples of the frequency of the oscillator constituting the timebase 2. For the outputs 3a, 3b, 3c and 3e, these frequencies are respectively 64, 32, 2 and 1 Hz. The outputs 3d and 3f deliver signals of the same frequency as the outputs 3c and 3e respectively, but of reverse or inverted polarity. FIG. 4 illustrates the phase relations between these several signals.

The control circuit 5 of the motor 4 includes a NAND gate 17 the inputs 17a and 17b of which are connected to the outputs 3f and 3c of the divider 3. The output 17c is connected to the inputs 18a and 19a respectively, of two OR gates 18 and 19 the second inputs 18b and 19b of which are connected, the one directly, the other one by the intermediary of an inverter 20, to the output 13a of the dephasing or checking circuit 13. The outputs 18c and 19c respectively, of the gates 18 and 19 are connected to the inputs 21a and 22a respectively, of two NAND gates 21 and 22, the inputs 21b and 22b of which are connected to the outputs 22c and 21c respectively. The gates 21 and 22 thus constitute an RS memory or flip flop, which will be designated hereafter as flip flop 21/22, the outputs 21c and 22c of which are moreover connected to the inputs 23a and 24a of two AND gates 23 and 24.

The outputs 23c and 24c of these AND gates are connected respectively to the inputs 25a and 26a of two NOR gates 25 and 26, the inputs 25b and 26b of which are connected, together, to the output 3e of the divider 3.

The output 25c of the gate 25 is connected to the input 27a of a NAND gate 27, having three inputs, and to the input 28a of an inverter 28. In the same or like way, the output 26c of the gate 26 is connected to the input 29a of a NAND gate 29, having three inputs, and to the input 30a of an inverter 30.

The inputs 27b and 29b of the gates 27 and 29 are connected, together, to the output 31c of a NOR gate 31, the inputs 31a and 31b of which are connected to the outputs 3a and 3b of the divider 3.

The output 27d of the gate 27 is connected to the input cl of a D type flip flop 32, the output $\overline{Q}$ of which is connected to its own input D, to the third input 27c of the gate 27 and to the second input 24b of the gate 24. The reset to zero input R of flip-flop 32 is connected to the output 28b of the inverter 28. In the same or like way, the output 29d of the gate 29 is connected to the input Cl of a D type flip flop 33 the output $\overline{Q}$ of which is connected to its own input D, to the third input 29c of the gate 29 and to the second input 23b of the gate 23. The reset to zero input R of flip-flop 33 is connected to the output 30b of the inverter 30.

The three first inputs 34a to 34c of a NAND gate 34, having four inputs, are connected, respectively, to the output 31c of the gate 31, to the output 3d of the divider 3 and to the output 21c of the flip flop 21/22. The output 34e of the gate 34 is connected to the input Cl of a third type flip flop D 35 the output $\overline{Q}$ of which is connected to its own input D and to the fourth input 34d of the gate 34. The reset to zero input R of flip flop 35 is connected to the output 22c of the flip flop 21/22.

An AND gate 36 has its two inputs 36a and 36b connected, respectively, to the outputs 27d and 34e of the gates 27 and 34. The outputs 36c and 29d of the gates 36 and 29 are connected, respectively, to the control electrodes of two p type MOS transistors, T1 and T2, the sources of which are connected, together, to the positive pole of the source of energy 1. The outputs 36c and 29d are moreover connected, by the intermediary of two inverters 37 and 38, to the control electrodes of two n type MOS transistors, T3 and T4, the sources of which are connected, together, to the negative pole of the source of energy 1.

The drains of the transistors T1 and T4 on the one hand and T2 and T3 on the other hand are connected, together, to the terminals of the motor 4.

The operation of this circuit is the following:

To begin with, one will consider the case where, the voltage of the source 1 is higher than the predetermined, the output 13a of the voltage circuit 13 delivers a logic signal 1 which maintains at the logic state 1, through the gate 18, the input 21a of the flip flop 21/22. The input 19b of the gate 19 is however maintained at the logic state 0 by the intermediary of the inverter 20. The output 19c of the gate 19 delivers consequently to the input 22a of the flip flop 21/22 the signal it receives from the output 17c of the gate 17. Each second, this signal passes to the logic state 0 for a quarter of a second, when the outputs 3c and 3f of the divider 3 are simultaneously at the logic state 1. This signal 0 puts the flip flop 21/22, if it is not already therein, into the state where its output 21c is at the logic state 0 and its output 22c at the logic state 1. As long as the output 13a of the dephasing circuit 13 remains at the logic state 1, the 21/22 remains in this state.

One can already note that the flip flop 21/22 can change its state only when the output 17c of the gate 17 is at the logic state 0. If the output 13a of the dephasing circuit 13 changes its state while this output 17c is at the logic state 1, the flip flop 21/22 does not change over immediately, but only when the output 17c passes to the logic state 0. If the output 13a changes its state while the output 17c is at the logic state 0, the flip flop 21/22 changes state immediately.

For the time being, the output 21c of the flip flop 21/22 is at the logic state 0 and the output 34e of the gate 34 is at the logic state 1. As long as the output 3e of the divider 3 is at the logic state 1, the outputs 25c and 26c of the gates 25 and 26 are maintained at the logic state 0, which locks the gates 27 and 29 the outputs 27d and 29d of which remain at the logic state 1, which, in turn, maintains the inputs R of the flip flops 32 and 33 at the logic state 1 through the inverters 28 and 30. Consequently, the outputs $\overline{Q}$ of these flip flops remain at the logic state 1 with the input R of the flip flop 35 being maintained at the logic state 1 by the output 22c of the flip flop 21/22. Consequently, the output $\overline{Q}$ of flip flop 35 is also at the logic state 1.

The outputs of the gates 27 and 34 are at the logic state 1, as is the output 36c of the gate 36 and, consequently, so is the control electrode of the transistor T1. The control electrode of the transistor T3 is maintained at the logic state 0 by the intermediary of the inverter 37. Consequently, these two transistors are locked off, as are the two transistors T2 and T4 the control electrodes of which receive respectively, a signal or logic state 1 from the output 29d of the gate 29 and a signal 0, or logic state from the output of the inverter 38. Consequently, the motor 4 does not receive any current and its rotor 8 remains stationary.

When the output 3*e* of the divider 3 passes to the logic state 0, the output 25*c* of the gate 25, the input 25*a* of which is already at the logic state 0, passes to the logic state 1. The output 26*c* of the gate 26 is, on the other hand, maintained at the logic state 0 by the logic state 1 which is maintained at its input 26*a*. After half a period of the signal delivered by the output 3*a* of the divider, the output 31*c* of the gate 31 passes to the logic state 1, which produces the passage to the logic state 0 of the output 27*d* of the gate 27. Consequently, the output 36*c* of the gate 36 passes to the logic state 0, which renders conductive the transistors T1 and T3. Consequently, the motor 4 receives current in one sense, arbitrarily designated as being positive, and its rotor starts to rotate.

After half a period of the signal delivered by the output 3*a* of the divider 3, the output 31*c* of the gate 31 passes again to the logic state 0, so that the output 36*c* of the gate 36 passes again to the logic state 1, which interrupts the passage of the current in the motor 4, the rotor of which has advanced one step. This passage to the logic state 1 of gate 36 produces simultaneously the change of state of the flip-flop 32 the output $\overline{Q}$ of which passes to the logic state 0 and, consequently, the inputs 27*c* and 24*b* of the gates 27 and 24 pass to the logic state 0. Therefore, the output 26*c* of the gate 26 passes to the logic state 1.

Figure 3:
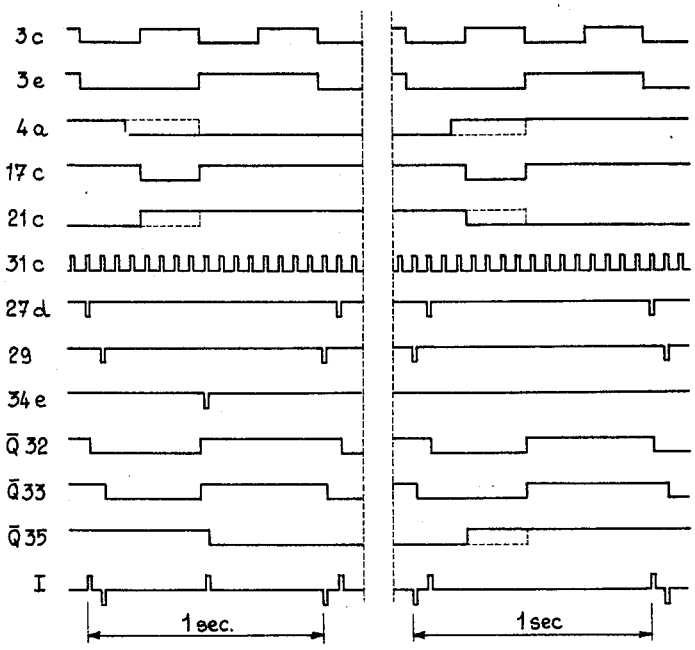
FIGS. 3 and 4 indicate the logic states at different points of this circuit.

It is to be noted here that, in FIG. 3, the width and the period of the pulses delivered by the output 31*c* of the gate 31 have been exaggerated, so as to render these pulses visible. In FIG. 4, on the other hand, the width and the period of the several signals have been respected or observed.

After a period of the signal delivered by the output 3*b* of the divider, the output 31*c* of the gate 31 passes again to the logic state 1. But, this time, it is the output 29*d* of the gate 29 which passes to the logic state 0, and the transistors T2 and T4 become conductive. Consequently, the motor 4 has a current pulse flow through it, the sense of which is opposite to the previous pulse, or negative, which current is interrupted when the output 31*c* of the gate 31 passes again to the logic state 0.

At this moment, the flip flop 33 changes its state and its output $\overline{Q}$ passes to the logic state 0, which locks the gate 29 and prevents the next pulses, coming from the output 31*c* of the gate 31, from reaching its input Cl.

Consequently, the motor 4 has received two driving pulses, each of opposite sense, which causes the rotor to advance two steps.

The circuit remains in this state until, half a second after its passage to the logic state 0, the output 3*e* of the divider 3 passes to the logic state 1. At this moment, the outputs 25*c* and 26*c* of the gates 25 and 26 pass to the logic state 0, and the inputs R of the flip flops 32 and 33 pass to the logic state 1, which resets the flip flops 32 and 33 into the state where their outputs $\overline{Q}$ are at the logic state 1. Consequently, the circuit is again in the starting state and each time the output 3*e* of the divider 3 passes again to the logic state 0, that is to say once each second, the process as disclosed hereinabove starts again and the motor receives again two current pulses, the first one, positive, by the intermediary of the output 27*d* of the gate 27, and the second one, negative, by the intermediary of the output 29*d* of the gate 29.

It has been seen hereinabove that, when the output 13*a* of the dephasing circuit 13 passes to the logic state 0, the flip flop 21/22 can change its state only when the outputs 3*c* and 3*f* of the divider 3 are simultaneously at the logic state 1. Consequently, this change of state is never produced while the motor 4 receives driving pulses.

When, due to the decrease of the voltage of the source of energy 1, this change of state has taken place, the input 34*c* of the gate 34 passes to the logic state 1. When the output 3*d* of the divider 3 passes also to the logic state 1, the gate 34 is ready to allow the passage, but reversed or inverted, of the pulses delivered by the output 31*c* of the gate 31. The output 3*e* of the divider 3 being at the logic state 1, the gates 27 and 29 are locked by the intermediary of the gates 25 and 26.

Consequently, the first pulse delivered by the output 31*c* of the gate 31 produces the passage of the output 34*e* of the gate 34 to the logic state 0, which renders conductive the transistor T1, by the intermediary of the gate 36, and the transistor T3, by the intermediary of the inverter 37. Consequently, the coil 7 of the motor 4 receives a positive pulse of current the duration of which is the same as that of the pulse delivered by the output 31*c* of the gate 31, so that its rotor 8 advances one step.

At the end of this pulse, the flip-flop 35 changes its state and its output Q passes to the logic state 0, which locks the gate 34 and prevents the next pulses, delivered by the output 31*c* of the gate 31 from reaching the gate 36. The outputs 21*c* and 22*c* of the flip flop 21/22 then being respectively at the logic state 1 and the logic state 0, it is the output 26*c* of the gate 26 which passes to the logic state 1 when the output 3*e* of the divider 3 passes to the logic state 0. Consequently, the first pulse delivered by the output 31*c* of the gate 31 after the passage to the logic state 0 of output 3*e* reaches, but in a reversed or inverted state, the output 29*d* of the gate 29. Consequently, the transistors T2 and T4 deliver at this moment a negative pulse of current to the motor 4. At the end of the pulse, as hereinabove, the flip flop 33 changes state, which applies a signal 0 to the inputs 29*c* and 23*b* of the gates 29 and 23. The input 25*a* of the gate 25 then passes to the logic state 0, its output 25*c* passing to the logic state 1, which allows the next pulse delivered by the output 31*c* of the gate 31 to reach the output 27*d* of the gate 27. Consequently, the transistors T1 and T3 are rendered conductive and deliver to the motor 4 a positive pulse of current.

Consequently, it can be seen that the order in which the driving pulses are delivered, each second, to the motor 4, is reversed with respect to the case where the output 13*a* of the checking circuit 13 is at the logic state 1. Since, at the moment of change of state of the flip flop 21/22, the motor 4 has received a supplementary pulse, it has taken an advance of one step which it keeps as long as the output 13*a* of the circuit 13 remains at the logic state 0.

In the case where the source of energy 1 is an accumulator or a rechargeable battery, the output 13*a* of the dephasing circuit 13 passes again to the logic state 1 during the recharge of the source of energy 1 so that the flip flop 21/22 changes state again, always at a moment where this change of state does not risk disturbing the delivery of the driving pulses. Consequently, the output 22*c* of this the flip flop 21/22 passes again to the logic state 1, which puts again, and maintains, the flip flop 35 into the state where its output $\overline{Q}$ is at the logic state 1. Simultaneously, the output 21*c* of the flip flop 21/22 passes to the logic state 0, which locks the gate 34 by its input 34c. Consequently, the pulses delivered by the output 31c of the gate 31 can no longer reach the output 34e of the gate 34 and the flip-flop 35 can no longer change state.

The circuit is again in the state disclosed initially and the first pulse delivered by the output 31c of the gate 31 after the passage to the logic state 0 of the output 3e of the divider 3 produces, as already disclosed, the passage of a positive pulse of current in the coil 7 of the motor 4. But the last pulse delivered to the motor before the resetting of the flip flop 21/22 was a positive pulse; consequently, the rotor 8 of the motor 4 does not move. The next pulse, delivered by the output 31c of the gate 31, produces, always as previously disclosed, the passage of a negative pulse of current. The motor then advances one step and is again in phase with the position it had before the passage of the output 13a of the dephasing circuit 13 to the logic state 0.

It is to be noted that the operation of the circuit will be the same if, for a fortuitous reason such as the passage of the watch to a very different temperature, the output 13a of the dephasing circuit 13 passes again to the logic state 1 before the source of energy 1 has been replaced or recharged, in accordance with how a battery, or an accumulator or a rechargeable battery, is used.

The disc 12 will also indicate to the user of the watch whether the watch is operating or not, since, in spite of the fact that one of the two zones of this disc seems to be permanently displayed, the short passage of the other zone produces a twinkling effect which is perceivable by the eye.

One can provide the case where, from the moment when the voltage of the source of energy reaches the predetermined threshold value, the rotor of the motor advances only one step at each rotation so that the two colors of the disc 12 appear successively and alternatively in the window of the dial, indicating to the user that the battery is to be changed or, in the case of an accumulator, or rechargeable battery that the latter is to be recharged.

If the watch is provided with a second hand, the disc 12 can be omitted, the indication of the end of life of the battery then being furnished by a dephasing of the second hand.

In the example hereinabove disclosed, the dephasing circuit 13 is a circuit of detection or of checking of the voltage of the source of energy. However, this circuit could be replaced by a counter modifying the phase of the motor once each twelve hours, at twelve o'clock noon and at midnight, the disc 12 then indicating not the state of the source of energy but whether the time displayed is that of the morning or AM or that of the evening or PM. One could also provide the case where the dephasing circuit would be constituted by a flip flop driven for instance by the control button or switch of the alarm, in the case of an alarm-watch, the disc 12 then indicating to the user whether the alarm is operating or not.

Figure 5:
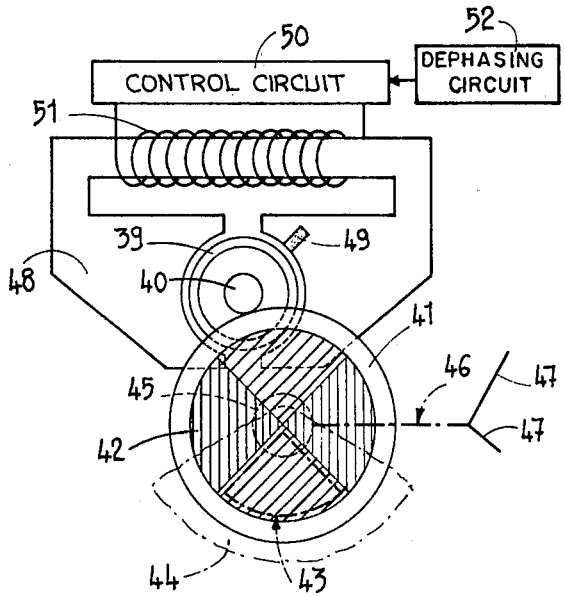
FIG. 5 is a plan view of a portion of a modification of an electro-mechanical watch.

In the modification of FIG. 5, the rotor of the motor, designated by 39, is constituted, as in the first embodiment, by a two poles permanent magnet which is rigidly connected with a pinion 40. Pinion 40 meshes with a wheel 41 which is rigidly connected with a disc 42 which constitutes the indicating member. This disc is divided into four sectors of different appearance. The four sectors are arranged in pairs with one of the pairs being visible at any one time through a window 43 provided in the dial, diagrammatically represented at 44.

The gearing ratio between the pinion 40 and the wheel 41 is such that, when the rotor 39 makes one revolution, the wheel 41, and consequently the indicating disc 42, make a quarter of a revolution. The wheel 41 is rigidly connected with a pinion 45 constituting the first element of a gearing, diagrammatically represented by a dot-and-dash line 46, leading to the time indicating members 47.

The stator of the motor, designated by 48, carries a magnet 49 acting on the rotor so that the rotor has only one position of balance and makes a whole revolution at each step.

The control circuit of the motor, designated by 50, acting on a coil 51 surrounding the stator 48, like the control circuit 5 of FIG. 1 acting on the coil 7 of the stator 6, is arranged in such a way that, in normal operation, the rotor 39 makes two revolutions for each train of pulses. When a dephasing circuit 52, which can be a circuit of detection similar to the dephasing circuit 13 of FIG. 1, changes its state, the rotor 39 makes three revolutions, which changes the sector which is opposite the window 43.

Thus, in this modification, one does not dephase the motor, as in the first embodiment, but one dephases the indicator through the gearing, which divides the rotation of the rotor and disc in an even ratio, so that it is sufficient, without dephasing the motor itself, to have the rotor make an uneven number of revolutions to dephase the indicator.

It is to be noted that the fact of placing the indicating disc on the element which immediately follows the rotor, in the gearing of the watch leading to the time indicators, allows balancing the gearing in such a way that it is less sensitive to angular accelerations.

What I claim is:

1. An electronic timepiece comprising:

a source of electric energy;

means coupled to the electric energy source for producing timebase pulses;

drive means responsive to the timebase pulses for producing drive pulses;

a stepping motor which is driven by the drive pulses;

time display means driven by the motor for displaying time;

an indicating member which is user viewable and which is rotated a predetermined amount by each step of the motor, the indicating member comprising a rotatable disc having a plurality of sectors of different appearance, a display window means adjacent the rotatable disc and having a shape which permits viewing of a single sector, the indicating member having at least one first rest position between steps of the motor to indicate no change past a determined value in a working parameter of the timepiece and at least one second rest position between steps of the motor to indicate a change past a predetermined value in the working parameter of the timpiece, the number of sectors of different appearance being equal to the number of rest positions, the indicating member having a normal rest position corresponding to the first rest position, one of the plurality of sectors being normally visible through the display window means when the indicating member has the first rest position; and means responsive to a change past a predetermined value in the working parameter for causing the drive means to produce an additional drive pulse, driving the stepping motor at least one step and modifying the normal rest position of the indicating member to the second rest position, whereby said one of the plurality of sectors which is normally visible is no longer adjacent the display window means, and a second one of the plurality of sectors of different appearance is adjacent the display window means, to thereby indicate a change in the working parameter.

2. The timepiece as claimed in claim 1 in which the source of electric energy includes a voltage output and the working parameter of the timepiece is the output voltage value of the source of electric energy and in which the means responsive to change past a predetermined value in the working parameter are responsive to the output voltage value falling below a predetermined threshold voltage value.

* * * * *